US009125453B2

(12) United States Patent
Keating et al.

(10) Patent No.: US 9,125,453 B2
(45) Date of Patent: Sep. 8, 2015

(54) SHOE OUTSOLE HAVING TUBES

(75) Inventors: Brian Keating, West Hills, CA (US); David Bond, Newbury Park, CA (US); Hyuk Oh, Woodland Hills, CA (US)

(73) Assignee: K-SWISS INC., Westlake Village, CA (US)

( * ) Notice: Subject to any disclaimer, the term of this patent is extended or adjusted under 35 U.S.C. 154(b) by 475 days.

(21) Appl. No.: 12/790,386

(22) Filed: May 28, 2010

(65) Prior Publication Data

US 2011/0289799 A1 Dec. 1, 2011

(51) Int. Cl.

| | |
|---|---|
| ***A43B 3/00*** | (2006.01) |
| ***A43B 13/12*** | (2006.01) |
| ***A43B 13/14*** | (2006.01) |
| ***A43B 13/18*** | (2006.01) |
| ***A43B 7/14*** | (2006.01) |

(52) U.S. Cl.

CPC ..... *A43B 13/181* (2013.01); *A43B 3/0042* (2013.01); *A43B 7/144* (2013.01); *A43B 13/122* (2013.01); *A43B 13/145* (2013.01)

(58) Field of Classification Search

CPC .... A43B 3/0036; A43B 3/0042; A43B 13/00; A43B 13/12; A43B 13/122; A43B 13/125; A43B 13/18; A43B 13/181

USPC ..... 36/25 R, 28, 31, 35 R, 36 A, 37, 103

See application file for complete search history.

(56) References Cited

U.S. PATENT DOCUMENTS

| | | | |
|---|---|---|---|
| 1,128,220 | A | 2/1915 | Bullard |
| 1,165,847 | A | 12/1915 | Cashman |
| 1,498,838 | A | 6/1924 | Harrison, Jr. |
| 1,929,126 | A | 10/1933 | Tuki et al. |
| 2,100,492 | A | 11/1937 | Sindler |
| 2,430,466 | A | 11/1947 | Hedman |
| 2,627,676 | A | 2/1953 | Hack |
| 2,710,461 | A | 6/1955 | Hack |
| 3,005,272 | A | 10/1961 | Shelare et al. |
| 3,533,171 | A | 10/1970 | Motoki |
| 3,719,965 | A | 3/1973 | Chevallereau |
| 3,834,046 | A | 9/1974 | Fowler |
| 4,183,156 | A | 1/1980 | Rudy |
| 4,297,797 | A | 11/1981 | Meyers |
| 4,438,573 | A | 3/1984 | McBarron |

(Continued)

FOREIGN PATENT DOCUMENTS

| | | | |
|---|---|---|---|
| AU | 613915 | B2 | 8/1991 |
| CN | 2299493 | Y | 12/1998 |

(Continued)

OTHER PUBLICATIONS

U.S. Appl. No. 12/945,237, filed Nov. 12, 2010, Keating, et al.

(Continued)

*Primary Examiner* — Khoa Huynh
*Assistant Examiner* — Sharon M Prange
(74) *Attorney, Agent, or Firm* — Rothwell, Figg, Ernst & Manbeck, P.C.

(57) ABSTRACT

A shoe sole structure includes an outsole having a plurality of cushioning members formed with the bottom surface of the outsole that can extend at least partially between the lateral edge and the medial edge of the shoe and also around a heel end of the shoe. One or more of the cushioning members can differ in size, location, orientation, length and/or material from one or more of the remaining cushioning members.

33 Claims, 12 Drawing Sheets

(56) References Cited

U.S. PATENT DOCUMENTS

| | | | | |
|---|---|---|---|---|
| 4,445,283 | A | 5/1984 | Meyers | |
| 4,445,284 | A | 5/1984 | Sakutori | |
| 4,521,979 | A | 6/1985 | Blaser | |
| 4,523,393 | A | 6/1985 | Inohara | |
| 4,536,974 | A | 8/1985 | Cohen | |
| 4,593,482 | A | 6/1986 | Mayer | |
| 4,602,441 | A | 7/1986 | El Sakkaf | |
| 4,611,412 | A | 9/1986 | Cohen | |
| 4,753,021 | A | 6/1988 | Cohen | |
| 4,754,559 | A | 7/1988 | Cohen | |
| 4,782,603 | A | 11/1988 | Brown | |
| 4,829,682 | A | 5/1989 | Gasbarro | |
| 4,910,884 | A | 3/1990 | Lindh et al. | |
| 4,914,836 | A | 4/1990 | Horovitz | |
| 4,934,070 | A | 6/1990 | Mauger | |
| 5,005,300 | A | 4/1991 | Diaz et al. | |
| 5,079,856 | A | 1/1992 | Truelsen | |
| 5,117,566 | A | 6/1992 | Lloyd et al. | |
| 5,295,314 | A | 3/1994 | Moumdjian | |
| 5,337,492 | A | 8/1994 | Anderie et al. | |
| 5,367,791 | A | 11/1994 | Gross et al. | |
| 5,461,800 | A | 10/1995 | Luthi et al. | |
| 5,493,792 | A | 2/1996 | Bates et al. | |
| 5,537,764 | A | 7/1996 | Prahl | |
| 5,577,334 | A | 11/1996 | Park | |
| D376,471 | S | 12/1996 | Kalin et al. | |
| 5,606,806 | A | 3/1997 | O'Dwyer | |
| 5,686,167 | A | 11/1997 | Rudy | |
| 5,694,706 | A | 12/1997 | Penka | |
| 5,713,140 | A | 2/1998 | Baggenstoss | |
| 5,761,831 | A | 6/1998 | Cho | |
| 5,761,833 | A | 6/1998 | McMullin | |
| 5,794,359 | A * | 8/1998 | Jenkins et al. | 36/28 |
| 5,797,199 | A * | 8/1998 | Miller et al. | 36/28 |
| 5,996,253 | A | 12/1999 | Spector | |
| 6,065,229 | A | 5/2000 | Wahrheit | |
| 6,266,897 | B1 | 7/2001 | Seydel et al. | |
| 6,305,100 | B1 | 10/2001 | Komarnycky et al. | |
| 6,510,624 | B1 | 1/2003 | Lakic | |
| 6,684,532 | B2 | 2/2004 | Greene et al. | |
| 6,769,202 | B1 | 8/2004 | Luthi et al. | |
| 6,773,785 | B1 | 8/2004 | Huang | |
| 7,013,583 | B2 | 3/2006 | Greene et al. | |
| 7,174,659 | B2 * | 2/2007 | Delgorgue | 36/59 R |
| 7,181,866 | B2 * | 2/2007 | Braunschweiler | 36/28 |
| 7,383,647 | B2 * | 6/2008 | Chan et al. | 36/28 |
| 7,398,608 | B2 * | 7/2008 | Schoenborn | 36/28 |
| 7,565,754 | B1 * | 7/2009 | Acheson et al. | 36/28 |
| 8,176,657 | B2 * | 5/2012 | Schinlder et al. | 36/28 |
| 2001/0011427 | A1 | 8/2001 | Seydel et al. | |
| 2002/0038522 | A1 | 4/2002 | Houser et al. | |
| 2006/0201028 | A1 | 9/2006 | Chan et al. | |
| 2007/0113425 | A1 * | 5/2007 | Wakley et al. | 36/28 |
| 2008/0289224 | A1 * | 11/2008 | Sink | 36/103 |
| 2009/0293309 | A1 | 12/2009 | Keating et al. | |

FOREIGN PATENT DOCUMENTS

| | | | |
|---|---|---|---|
| CN | 101961158 | A | 2/2011 |
| DE | 81 26 601.4 | | 12/1981 |
| DE | 32 45 182 | | 5/1983 |
| DE | 3832743 | A1 | 9/1988 |
| DE | 37 35 496 | | 5/1989 |
| DE | 297 15 533 | | 3/1998 |
| DE | 195 20 374 | | 12/1998 |
| DE | 298 18 243 | | 3/1999 |
| DE | 198 08 670 | | 9/1999 |
| EP | 0 298 449 | | 1/1989 |
| EP | 0 335 060 | | 10/1989 |
| EP | 0 346 298 | | 12/1989 |
| EP | 0 571 103 | | 11/1993 |
| EP | 1 264 556 | | 12/2002 |
| FR | 2 695 809 | | 3/1994 |
| FR | 2 709 929 | | 3/1995 |
| GB | 2 001 843 | | 2/1979 |
| GB | 1 603 646 | | 11/1981 |
| GB | 2 285 569 | | 7/1995 |
| JP | S49-096158 | | 12/1972 |
| JP | 64-86902 | | 3/1989 |
| JP | 5-309001 | | 11/1993 |
| JP | 06-050508 | U | 7/1994 |
| JP | 7-284403 | | 10/1995 |
| JP | 8205907 | A | 8/1996 |
| JP | 11-196905 | | 7/1999 |
| JP | 2000-166605 | | 6/2000 |
| WO | 81/01234 | | 5/1981 |
| WO | 81/02969 | | 10/1981 |
| WO | 90/00021 | | 1/1990 |
| WO | 9111928 | A1 | 8/1991 |
| WO | 98/21991 | | 5/1998 |
| WO | 99/51118 | | 10/1999 |
| WO | 01/17384 | | 3/2001 |
| WO | 02/37995 | | 5/2002 |

OTHER PUBLICATIONS

Notification of Second Office Acton, Chinese Application No. 201110139848.9, Notification Date: Dec. 27, 2013, 8 pages.

* cited by examiner

SHOE OUTSOLE HAVING TUBES

BACKGROUND OF THE INVENTION

1. Field of the Invention

This invention relates to sport or athletic shoes. According to an example, the shoes are constructed to provide a damping action and minimize impact shock as well as increase stability and support. More particularly, one or more examples of the present invention relate to a ground engaging system including a plurality of cushioning elements projecting downward from an undersurface of an outsole to reduce the impact force transferred to the user.

2. Description of the Related Art

In most types of footwear, especially athletic shoes, an outsole is attached to the midsole and is generally designed to resist wear and provide traction. The midsole is designed primarily to provide stability for the foot while attenuating shock. When running and walking, generally the foot makes initial contact with the ground surface on the lateral portion of the rearfoot area. At initial contact, runners typically strike the ground at a force of 2.5 times their body weight, which may be repeated at a rate of 180 times per minute (90 per each foot). Therefore, the heel strike cushioning portion of the shoe should have a firmness to provide for proper impact cushioning.

The modern athletic shoe is a combination of elements, which cooperatively interact in an effort to minimize weight and maximize comfort, cushioning, stability and durability. The cushioning in most athletic shoes is supplied through the foam midsole that can be made from either ethylene vinyl acetate (EVA) or polyurethane. These materials provide ample cushioning when they are new, but lose some of the cushioning ability over time due to failure of the structured materials by the application of shear and vertical forces applied to them. The shoe industry trend has been toward thickening the midsoles of athletic shoes to enhance the cushioning effect of the sole. An added thickness of foam, however, can cause the sole to have increased stiffness in bending. Under these conditions, the lateral corner of the sole can tend to operate as a fulcrum upon heel strike and create an extended lever arm and greater moment, which can cause the foot to rotate medially and pronate with greater velocity than desired. This can lead to over-pronation of the foot and possible injury. Further, this condition can present a potentially unstable condition for the foot and result in the transmission of higher than desired levels of impact stress due to the relatively small surface area of contact.

SUMMARY OF THE INVENTION

According to an aspect of the invention, it has been recognized that prior shoe designs suffer from one or more disadvantages including poor lateral support, not completely absorbing an impact, and designs that cause over-pronation of the foot and possible injury.

The present invention relates to improved shoes that address the competing concerns of cushioning and stability with the ground support phase of running and walking in at least one of the heel strike area and the forefoot area in order to minimize stresses and strains on the wearer.

A shoe according to an example of the invention provides improved shock absorption upon heel strike without relying on soft midsoles to obtain the needed shock absorption during both the initial heel impact and the forefoot impact during running and walking.

According to an example, the invention pertains to athletic footwear used for running and walking. More specifically, an example pertains to athletic shoe constructions designed to attenuate applied force and shock, and to provide support and stability during running and walking. In one example, the invention utilizes at least the ground engaging region of the outsole of a shoe to provide increased shock absorption upon impact, while transitioning into stability and support during running and walking.

In one example, the athletic footwear includes an upper, a midsole, and an outsole attached to the upper. According to an improvement, the sole of the shoe includes one or more tube structures as part of a ground contacting system, which extend substantially transversely to the longitudinal axis of the shoe. In an example, the one or more tubes form three dimensional deformable elements as part of the outsole and act to cushion foot impact, dissipate energy, and reduce the force transferred to the user.

The one or more tube portions in an example of the invention are designed to deform both vertically, e.g. compress substantially perpendicular to the ground surface toward the foot, and horizontally, e.g. shear or deform in a plane substantially parallel to the ground surface. As such, the one or more tubes dissipate the force of the foot impact and therefore minimize the force transferred to the user, which results in reduced overall stress and strain on at least a wearer's feet, ankles, shins, knees, back and joints.

As an example of the invention, the one or more tubes can extend different lengths across the width of the shoe. For example, a shoe can have a first tube formed in a heel area of the shoe that extends from a medial side of the shoe to a lateral side of the shoe. Adjacent the first tube for example, the shoe can have a tube that extends from either the medial and/or lateral side of the shoe to a middle portion of the shoe, but not completely across the shoe.

One or more embodiments of the invention provides for having one or more of the tubes with different shapes and sizes and made from different materials. As not all areas of the outsole are subjected to the same forces at impact, shoes of one or more embodiments are designed to have tube portions of a different size, shape, and/or material provided at various positions on the outsole to reduce the impact felt by the user and maximize support and performance.

In an example, a shoe can have one or more tubes that deform in a substantially horizontal, vertical, and/or lateral direction. In an example, one or more tubes can be designed to primarily deform in only one of the horizontal, vertical and lateral directions.

In one or more embodiments, the deformation characteristics of the tubes formed in the heel area can be the same or different from deformation characteristics of the tubes formed in the forefoot area of the shoe. The heel strike cushioning portion of the shoe should have a firmness to provide for proper impact cushioning, therefore, the one or more tubes formed in the heel should have adequate shock absorbing characteristic, and therefore should be able to at least partially vertically deform. The heel region tubes could also undergo significant horizontal deformation and therefore, could be designed to distort substantially horizontally as well as vertically.

In one or more examples of the invention, the cushioning elements are formed by an upwardly curved portion of a bottom surface of the outsole. Downwardly curved regions of the outsole are formed opposite the upwardly curved regions to thereby form the cushioning elements hereinafter discussed as tubes. In an example, one or more tubes can have any desirable shape, for example, substantially circular or oval shape, prior to deformation.

In a further example of the invention, a shoe can have tubes formed in the heel, middle, and/or forefoot portion of the shoe. In an example, a longitudinal axis of one or more tubes located in the heel portion can be oriented substantially perpendicular to a longitudinal axis of the shoe. In a further example, one or more tubes can be formed in the heel area so that a longitudinal axis of the tube is substantially parallel to the longitudinal axis of the shoe. Any desirable angle between the longitudinal axis of one or more tubes and the longitudinal axis of the shoe, for example substantially forty-five degrees, is within the spirit and scope of the present invention.

In a further example, tubes adjacent each other from a medial side of the shoe having an open end facing outwardly are formed continuously around the heel portion of the shoe to the lateral side of the shoe.

As an example of the invention, the one or more tubes members can have a varying wall thickness along the length of the tube. In a further example, one or more tubes can vary in thickness in the width direction of the tube.

A difference in wall thickness for one or more tubes can be based on which area of the shoe will be subject to higher impact forces. In an example, the wall thickness of the tube members in the rear or heel portion of the shoe is thicker than the wall thickness of the tube members closer to the forefoot portion of the shoe.

Embodiments of the present invention have a plurality of tubes adjacent to each other and extending transversely between the lateral side edge to the medial side edge of the midsole such that a longitudinal axis of the one or more tubes are oriented substantially perpendicular to the longitudinal axis of the shoe.

In one or more examples, an interior of one or more tubes can include projections extending along a longitudinal axis of the tube and/or transverse to the longitudinal axis. In a preferred embodiment, the projections are provided on each of an upper interior surface and a lower interior surface.

In an example, a lower surface of the outsole is made from a hard material, such as plastic, which covers one end of one or more tubes and may extend a distance within the one or more tubes.

In an alternative embodiment, a ground engaging surface of the one or more of the tubes can be provided with projections, for example raised cleats that increase the wall thickness in selected areas and provide traction and durability.

As should be apparent, the invention can provide a number of advantageous features and benefits. It is to be understood that in practicing the invention, an embodiment can be constructed to include one or more features or benefits of embodiments disclosed herein, but not others. Accordingly, it is to be understood that the preferred embodiments discussed herein are provided as examples and are not be construed as limiting, particularly since embodiments can be formed to practice the invention that do not include each of the features of the disclosed examples.

BRIEF DESCRIPTION OF THE DRAWINGS

The invention will be better understood from reading the description which follows and from examining the accompanying figures. These are provided solely as non-limiting examples of the invention. In the drawings.

DETAILED DESCRIPTION OF THE PREFERRED EMBODIMENTS

Figure 1:
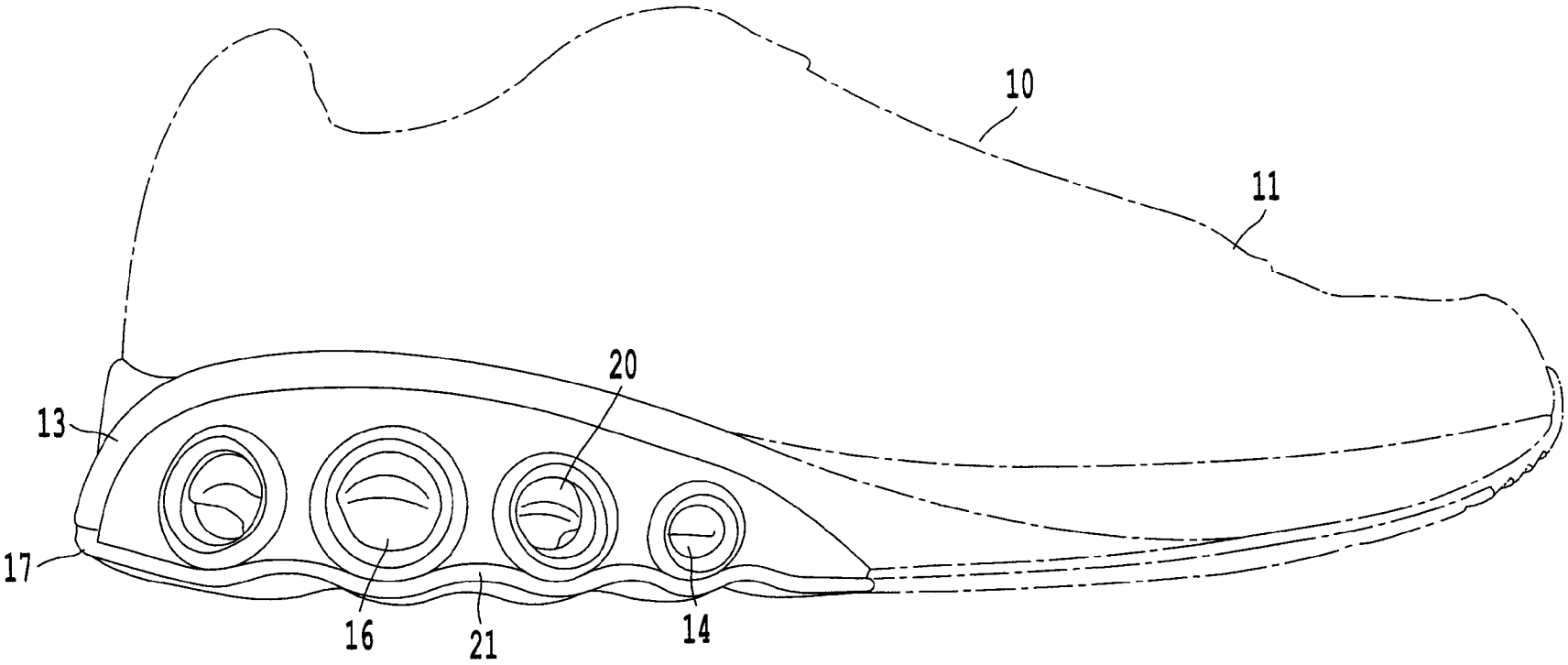
FIG. 1 is a side view of the lateral side of an athletic shoe according to an example of the invention.

Reference will now be made in detail to the present preferred embodiments of the invention, examples of which are illustrated in the accompanying drawings. Wherever possible, the same reference characters will be used throughout the drawings to refer to the same or like parts.

Figure 2:
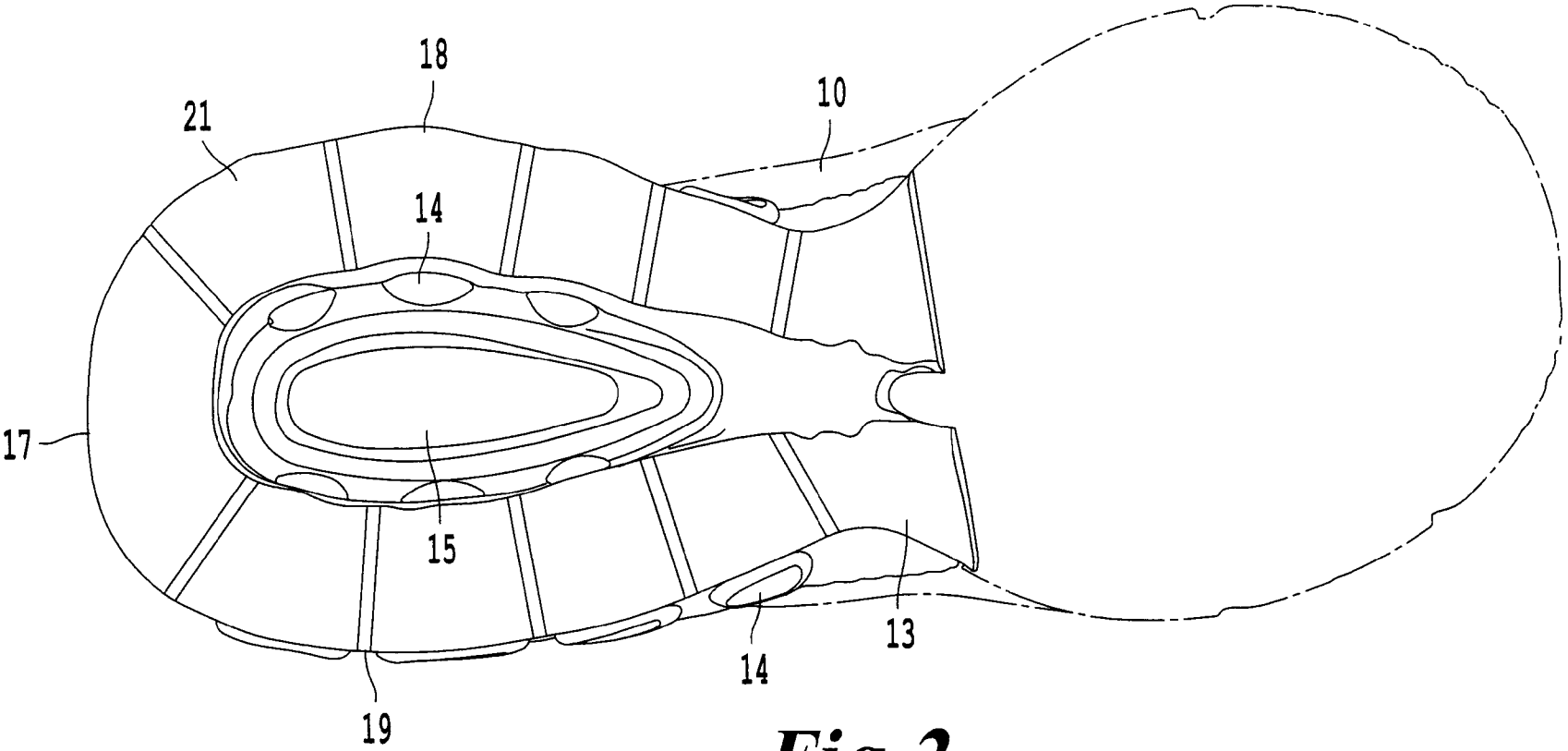
FIG. 2 is a bottom view of an athletic shoe according to an example of the invention.

FIGS. 1 and 2 illustrate an example of an embodiment of a shoe 10 of the present invention. The shoe 10, in the illustrated example, is an athletic shoe. An upper 11 of the athletic shoe 10 is typically fabricated from for example, stitched fabric, leather, canvas or other types of synthetic materials. The upper 11 also includes a midsole portion (not shown) that may or may not be attached to upper 11 and can be made from for example, a foam or soft rubber type material. Shoe 10 has an outsole 13 that includes a plurality of cushioning elements or tubes 14. Such shoes can be designed for tennis, running, walking, basketball, or other activities. Of course, it should be appreciated that the shoe of exemplary embodiments can be any type of shoe for any use desired by the wearer, which might benefit from an outsole 13 at least partially formed with tubes 14.

The tubes 14 of this invention preferably include at least one tube 14 capable of undergoing distortion in at least one of three independent directions in response to an applied force. The tubes 14 are associated with regions of the outsole that carry the load associated with foot impact and standing. For example, the tubes 14 located in the heel and/or forefoot region of the shoe 10 are configured to deform both vertically and horizontally. In this way, the force that is transmitted to the wearer's foot and other body structures such as muscles and tendons, is reduced as well as the stress and strain on the joints. The tubes 14 provided in the heel are made from a material, for example rubber, that will allow the one or more tubes 14 to act like a spring due to the compression of the tube 14 and the elasticity of the material.

The tubes 14 can be provided that have material, layers, shape, size, location, density, and/or other characteristics that can be different from other tubes in one or more positions of the outsole 13 so that a shoe 10 can be provided that will offer the user a desired performance and stability characteristic as well as cushioning that will dissipate the force of the foot impact and minimize the force transferred to the user. Described herein are tubes 14 which are disposed along the outsole 13 of a shoe. The one or more tubes 14 provide both cushioning and energy return without adversely affecting the overall stability characteristics of the shoe. Accordingly, material selected for the tubes should be material having characteristics, which can affect the overall performance of the shoe.

According to embodiments of the invention, the outsole 13 can include one or more tubes 14 provided along any portion of the outsole 13, for example, along an outer edge and/or in a middle portion of the outsole 13 substantially along a longitudinal axis of the shoe 10. In one or more examples of the invention, the tubes are formed by an upwardly curved portion of a bottom surface of the outsole. Downwardly curved regions are provided opposite the upwardly curved regions to thereby together form the tubes. The upwardly and downwardly curved regions form the tubes 14 that can have a substantially circular or oval shape. In an example, the curved or oval shape can be seen on at least an end of the tube 14 facing to the outside of the shoe 10. In embodiments of the invention, the tubes 14 can have the same or different shape along the length of the tube 14.

In an example, an outwardly facing end of one or more tubes is circular or oval while at least a portion along a length of the tubes 14 is approximately the shape of a half tube. That is, the tubes 14 can be formed as full tubes that extends along at least part of the outsole 13 of the shoe 10 or be formed as part of a semicircle extending along at least part of the outsole 13. However, the tubes 14 can be any desirable size and shape.

For example, the tubes 14 incorporate an approximately 360 degree configuration. In an example, the tubes are formed as a circumference of a circle. A further example provides for a configuration of the tube to be provided as a portion of a complete circle, for example 180 degrees. It should be appreciated that the tubes 14 of one or more examples of the invention can be any desirable size and shape, for example circular or oval, as well as having partially circular and/or partially substantially planar regions.

In one or more examples of the invention, the lower surface of the tube 14 is curved upwardly at least substantially the length of the tube 14. Therefore, a cross section of the curved lower surface would form an arc that extends in a lengthwise direction of the shoe 10. In a further example, the upper inner surface of the tube 14 can curve from the end of the tube 14 that faces away from the shoe downwardly and then continue curving along at least part of its length towards the end of the tube facing a middle region 15 of the shoe 10. That is, a cross section of the upper surface would form an arc at least along a portion of its length with the arc extending along a widthwise direction of the shoe. As discussed herein, the cross section formed by one or both of the upper and lower surfaces does not have to form a continuous arc and can include at least substantially linear cross sectional regions.

The tubes 14 can be made from an elastic material, such as rubber or thermoplastic polyurethane (TPU). Further, the tubes 14 can be provided immediately adjacent each other or can be spaced apart. Additionally, the spacing between the tubes 14 can be the same or different between tubes 14 provided next to each other.

When the shoe 10 comes in contact with a firm surface, the one or more tubes which generally have a curved exterior ground contacting surface, will deflect or compress partially upon impact to absorb shock. As discussed herein, the amount of deflection or compression of the one or more tubes 14 can be derived from the firmness of the material used for the tube member 14 as well as other variables, such as spacing between tubes 14, size of tubes 14, orientation of the tube 14, location of tubes 14 on the outsole, and/or the wall thickness of the tube member 14. For example, when impact forces are applied to the tubes, the tubes are compressed and are therefore no longer have their original shape. Further, material between the tubes is compressed. This compression in turn can help to resist further compression of the tube since the more the tube is compressed the more difficult it is to compress the tube further. In an example, the tubes 14 are spaced apart sufficiently such that upon distortion and compression, the tubes do not come into contact with each other. In this way, changes in the cushioning effect can be avoided and a substantially constant pressure gradient through the thickness of the tubes and outsole can be achieved. Of course, further examples of the invention allow for the tubes in the partially compressed or uncompressed state to contact each other.

In the example shown in FIGS. 1 and 2, the plurality of tubes 14 are provided in substantially the heel area 17 of the shoe 10 and extend from each of the lateral portion of the heel and the medial portion of the heel to a region in the center of the heel. In an example of the invention, a gap is provided between the lateral and medial tubes 14 in a region of the center portion 15 of the heel. In this way, the tubes 14 extending from the lateral side 19 of the shoe are spaced apart from the tubes 14 extending from the medial side 18 of the shoe. In the example of FIGS. 1 and 2, a tube 16 that resides in approximately a middle of the remaining tubes in a longitudinal direction of the shoe on the lateral and/or medial side of the shoe, is a tube having the largest diameter at least facing to the outside of the shoe. It should be appreciated that any of the tubes 14 in any location could have the largest or smallest diameter.

Further, in one or more examples of the invention, it should be appreciated that the tubes 14 that are located on the lateral 19 and medial 18 sides of the shoe 10 do not have to be located directly across the width of the shoe from each other or oriented at the same angle as each other, with respect to the longitudinal axis of the shoe 10. For example, the tube located closest to the back heel end 17 of the shoe 10 on the medial side 18 of the shoe can be closer to the back heel end 17 of the shoe than the rearmost tube located on the lateral 19 side of the shoe. Of course, either tube can be located rearmost on the shoe 10 according to design and/or performance requirements and desires.

In the example of FIGS. 1 and 2, one or more of the tubes 14 have a different diameter for the tube portion that faces an outside of the shoe 10 compared to the portion of the tube 14 facing the center portion 15. It should be appreciated that in one or more examples of the invention, the tubes 14 can have a substantially constant internal diameter from one end of the tube to the other end no matter whether the tube 14 extends across the entire width of the shoe or only partially across the width. Alternatively, one or more of the tubes 14 can have a tapered interior region which tapers from one end of the tube to the other. The tapered region can be formed from a tapered lower interior tube portion (upwardly curved) or a tapered upper interior surface (downwardly curved) of the tube.

In an embodiment, the internal region of one or more tubes 14 can have planar regions in addition to curved regions. For example, a planar region can be formed along a lower interior surface of the tube substantially parallel to a ground surface that the shoe will contact. Instead of or in addition to the lower interior surface, the upper interior surface of the tube 14 can be substantially planar.

In an example of the invention, the material that forms the ground engaging surface and surrounding portions of the tubes 14 can be the same or a different material that makes up the remaining portions of the tube 14. As shown in the figures, an upper surface 20 in an interior region of the tubes 14 can be formed by a surface of the outsole 13. The upper surface 20 of the outsole 13 formed in the tubes 14 can be curved or planar and be the same shape as or different from the remaining portions of the interior of the tube 14.

As shown in the figures, one or more of the tubes 14 can be formed as substantially a circle or oval at a peripheral edge of the tube 14 facing an exterior of the shoe. In an example, the tube 14 is formed of the same material around a complete circumference of the tube 14. Along a length of the tube 14 extending towards the center portion 15 of the shoe 10, a bottom half of tube 14 can be formed of the material that forms the ground engaging surface, and a top half of the tube can be made from material that forms a lower portion of a lower surface of the outsole. That is, the material forming the ground engaging portion of the tube 14 can form approximately one half of a tube, for example the bottom half, and the outsole portion made of a same or different material can form the other half, for example the upper half. In an example of the invention, when the lower half is made from rubber, a substantial majority of the upper half can be made substantially from TPU or foam. During use and after impact, the forces applied to the tubes are removed. The material chosen for at least the lower half of the tube should have good memory characteristics and therefore readily return to the original configuration. Because the material of the tubes 14 has been compressed, a force is generated in the compressed material to help the tubes 14 return to their original shape, which in turn helps return energy to the wearer.

One or more embodiments include an inner support surface extending along the top and/or bottom portion of the tube to support the top and/or bottom of the tube. In an example, the inner support surface can be made from the same or similar material as the material forming the top and/or bottom half. In this way, the top and/or bottom half of the tube 14 can be supported by the inner support surface.

In the example of FIGS. 1 and 2, a lower surface of the tube members 14 are covered by a layer 21 of the outsole that acts as a ground engaging surface of the outsole. The ground engaging surface 21 can extend from a region in the middle of the bottom of the shoe 10 and cover a bottom of the tube members 14. The ground engaging surface 21 can be formed to extend under each tube 14 and extend between each tube 14 at the ground engaging surface level. As such, the ground engaging surface 21 can have a curved shape matching the curved bottom surface of each tube 14 as the layer 21 extends along the bottom surface of each tube 14. In a further example, the ground engaging member can be substantially planar. In an example, the ground engaging surface can be made from the same material as the tubes 14. However, the ground engaging surface can be made from a different material than the tubes 14 and other portions of the outsole.

Figure 3:
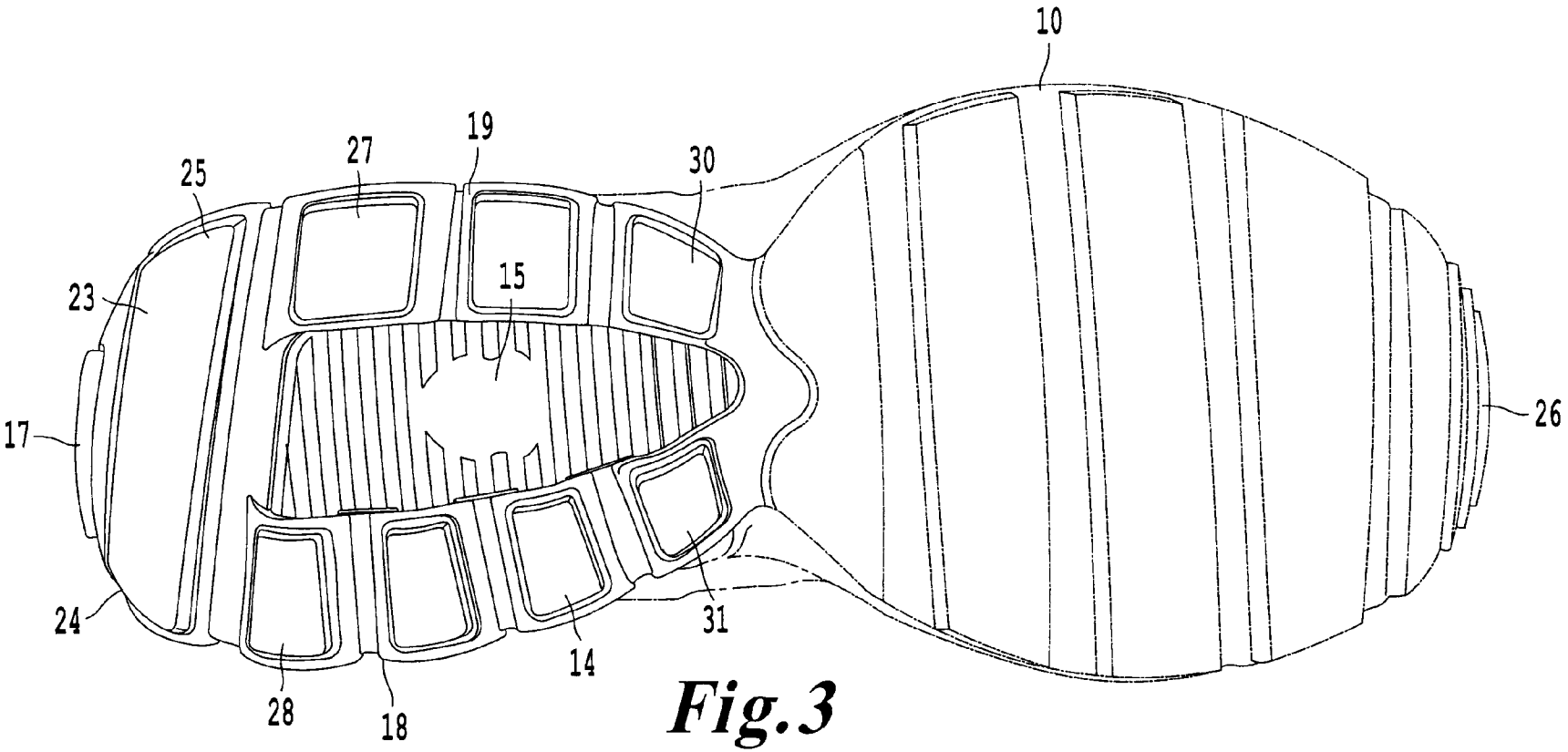
FIG. 3 is a bottom view of the an athletic shoe according to a further example of the invention.
Figure 4:
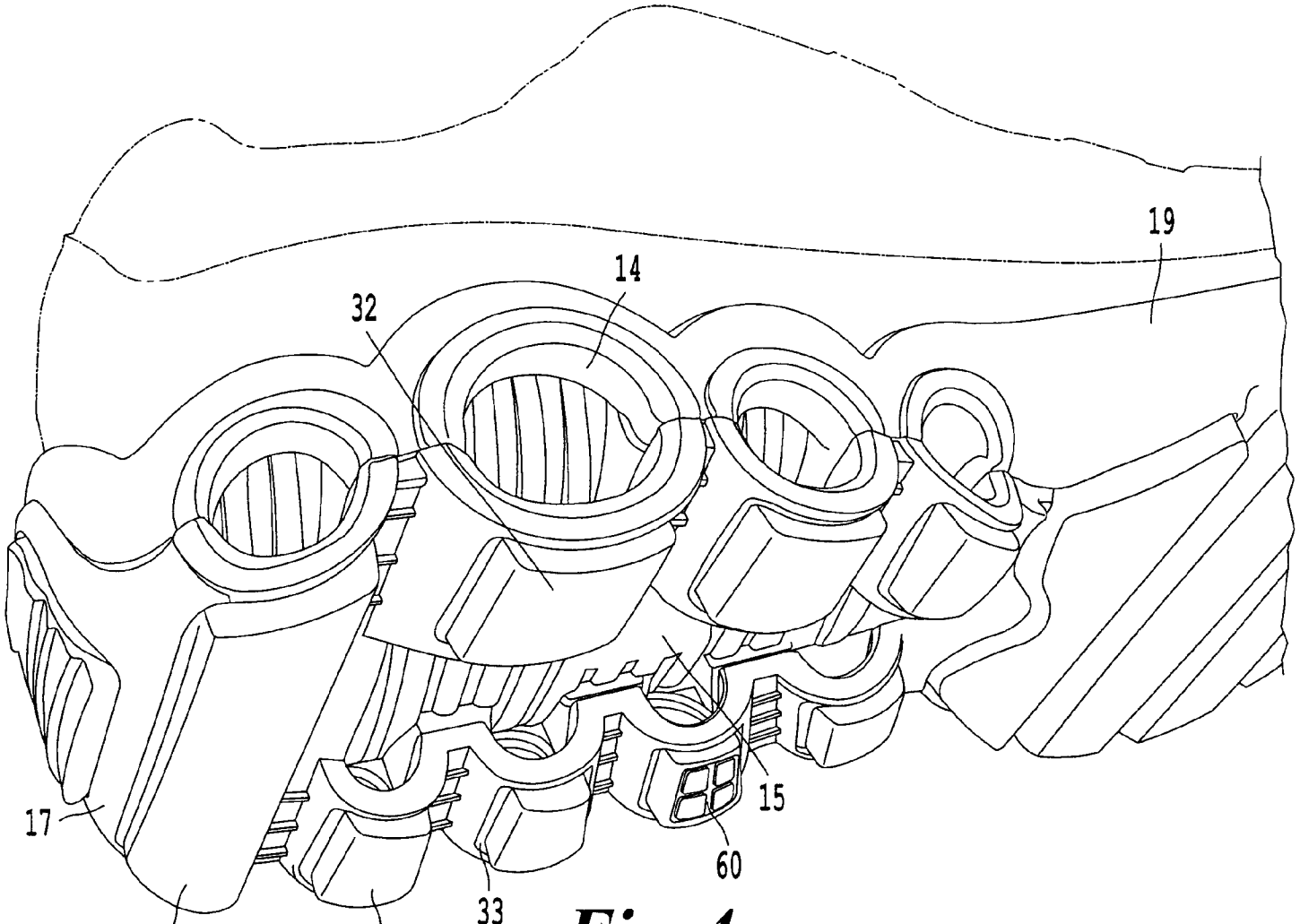
FIG. 4 is an elevation view of the lateral side of an athletic shoe according to an example of the invention.
Figure 5:
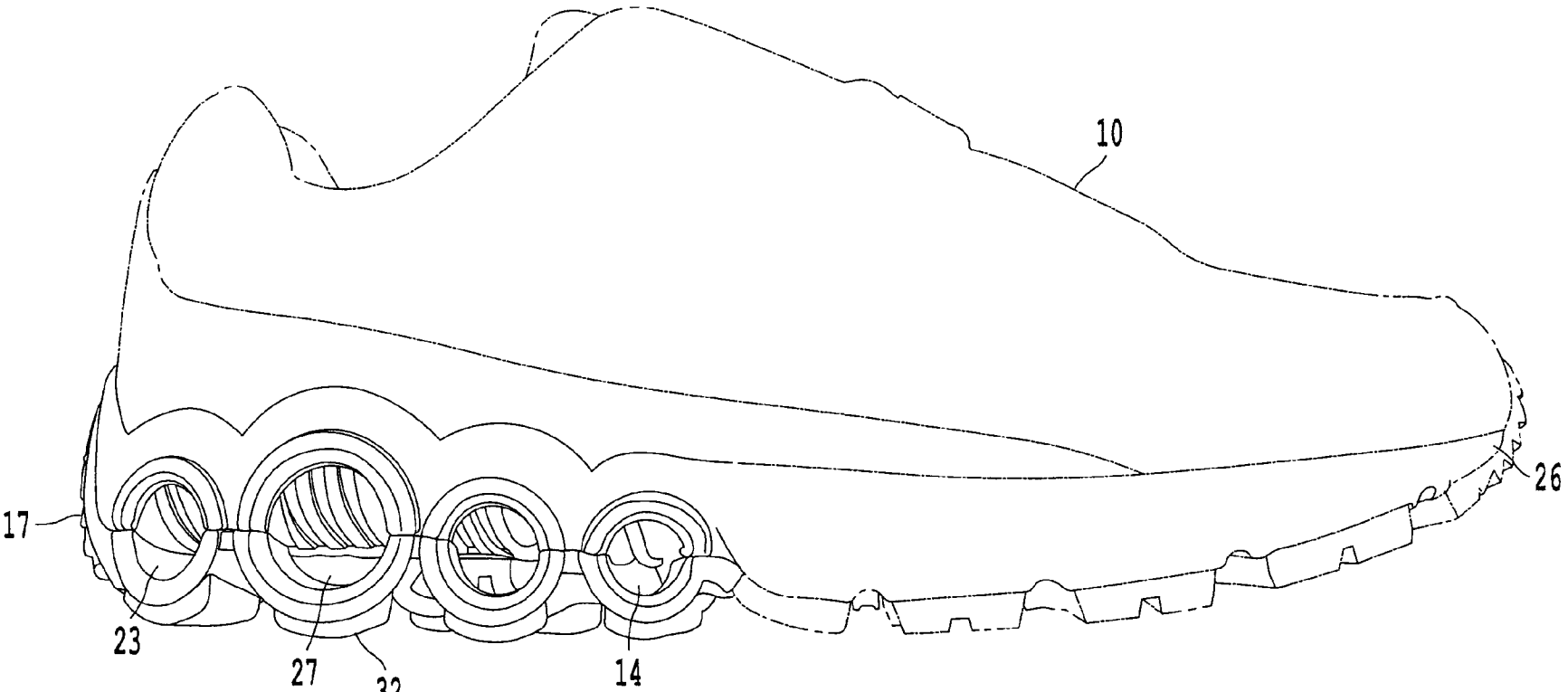
FIG. 5 is a lateral view of the outsole of the athletic shoe.

In a further example of the invention, the shoe shown in FIGS. 3 to 5 is an alternate embodiment of the invention. As best shown in FIGS. 3-4, one or more of the plurality of tubes 14 are provided in substantially the heel area 17 of the shoe 10 and extend from each of the lateral side 18 of the heel and the medial side 19 of the heel to the center region 15. In this way, the tubes 14 extending from the lateral side 18 of the shoe are spaced apart from the tubes 14 extending from the medial side 19 of the shoe. It should be appreciated that each tube member 14 can extend a different distance across the width of the shoe, for example, completely or partially across the width. The distance that a tube 14 extends across the width of the shoe 10 can be the same or different from tubes 14 located on the same side of the shoe as well as the same or different from tubes 14 located on the opposite side of the shoe 10.

An embodiment includes at least one tube 23 that extends a different length across the bottom of the shoe 10 than any of the other tubes 14. For example, the tube 23 located closest to the back end 17 of the shoe extends completely across the width of the shoe, from the lateral side 18 of the shoe to the medial side 19. In this way, the rearmost portion of the heel 17 includes a tube 23 that covers the heel strike area furthest to the rear of the shoe that will deform and absorb impact forces during use by the wearer.

In one or more embodiments of the invention, for example as shown in FIG. 3, the rearmost tube 23 that extends across the width of the sole is not oriented perpendicular to the longitudinal axis of the shoe. When running and walking, generally the foot makes initial contact with the ground surface in the rearfoot area. In a preferred embodiment, in order to provide sufficient absorption of impact forces, the rearmost tube 23 is formed at an angle such that the end of the tube 24 on the medial side 19 of the shoe is located further back towards the heel end 17 of the shoe than the end of the tube 25 located on the lateral side of the shoe 18.

Additionally, in one or more examples of the invention, the outside opening of the tubes 14 facing the center portion 15 can be located different distances from the center portion 15. As best shown in FIGS. 3 and 4, the opening of the tubes 14 towards the center portion 15 located near the back heel end 17 are closer together than the tubes extending towards a toe end 26 of the shoe. That is, the spacing of the tubes 14 can curve towards the longitudinal axis of the shoe as the tubes 14 are formed closer towards the toe end 26.

Due to runners generally striking the ground at a force of several times their body weight at initial contact, the heel strike cushioning portion must provide for proper impact cushioning. Therefore, in an example, the size of the tube opening 25 on the lateral side 18 of the shoe for the rearmost tube 23 is greater than the tube opening 24 on the medial side 19 of the shoe. That is, the tube is tapered from a larger diameter on the lateral side 18 to a smaller diameter on the medial side 19. It should be appreciated that in one or more embodiments of the invention, the tapering does not need to be constant from one side of the tube to the other and therefore, any of the tubes 14 can have an internal diameter that varies along the length of the tube 14 whether the tube extends the entire width of the shoe or only partially across the width of the shoe 10.

Further, due to an angle formed by the tube 23 and the size of the tube 27 compared to the tube 28, the tubes located on the different sides of the shoe can be formed at different distances from the rear heel end 17. In further examples, the tubes can be spaced apart from each other differently and therefore be provided at a similar distance from heel end 17. As shown in FIG. 3, tubes 27 and 28 are located at different distances from the heel end 17. However, tubes 30 and 31 are located at least substantially the same distance from the heel end 17. Additionally, the tubes on the lateral side 19 can be oriented at different angles with respect to each other as well as formed at different angles with respect to corresponding tubes on the medial side 18. For example, a longitudinal axis of the tubes located on the lateral side 19 can form a different angle with respect to a plane normal to the longitudinal axis of the shoe, than an angle formed by the tubes on the medial side 18.

In the example best shown in FIG. 3, the tube 27 located on the lateral side 19 of the shoe closest to tube 23, is larger than the other tubes 14 located on both the lateral 19 and medial 18 sides. That is, a diameter of tube 27 is larger than a diameter of tube 28, for example. Due to the larger diameter of tube 27, there are fewer tubes located on the lateral side 19 compared to the number of tubes located on the medial side 18. Embodiments of the invention provide for the same or different number of tubes on the lateral 19 and medial 18 sides of the shoe.

In an example of the invention, the material that forms the bottom half of the tubes 14 can be the same or a different material that makes up the remaining portions of the tube. As shown in the figures, an upper surface in an interior region of the tubes 14 can be formed by a lower surface of the outsole 13 that forms the remaining portions of the outsole. The portion of the outsole 13 formed in the interior of tubes 14 can be curved or planar, grooved or substantially smooth. Accordingly, the material, for example rubber, forming the ground engaging portion of the tube 14 can form approximately one half of the tube, for example the bottom half, and the outsole portion made of a same or different material can form the other half, for example the upper half.

In an example, one or more of the tubes 14 on the medial 18 and/or lateral 19 sides includes a protrusion 32 formed on a bottom surface of the one or more tubes 14. The protrusion 32 can be planar or non-planar and reside in a recess 33 formed in the bottom of the tube 14 and project below the bottom surface of the outer curve of the tube 14 towards a ground engaging side. The protrusion 32 can be formed on one or more of the tubes, including tube 23 that extends across the width of the shoe. The protrusions can be for example, raised cleats that provide traction and durability on a firm surface.

In an embodiment, instead of or in addition to the protrusion 32, one or more of the tubes 14, for example the bottom surface of the tube, can have at least one groove 60 extending along a surface of the tube 14. The at least one groove 60 can be provided for enhanced traction on different types of surfaces. The groove 60 can extend the length of the tube 14, or can extend only a portion of the length of the tube 14. In an example, a center groove can extend completely across the length of the tube, while grooves on either side of the center groove only extend partially across the length of the tube 14. Further, the groove(s) 60 can be formed at any location on the tubes 14, for example in a similar direction to a longitudinal direction of the shoe 10 or perpendicular to the longitudinal direction of the shoe 10. It should be appreciated that the grooves 60 can have a different depths than other grooves 60 formed on the same tube 14. Further, grooves 60 of one tube 14 can have different depths than grooves 60 formed in other tubes 14. Each groove 60 on the tube 14 can effectively reduce the wall thickness of each tube, which can allow for increased deflection or compression upon impact.

Figure 6:
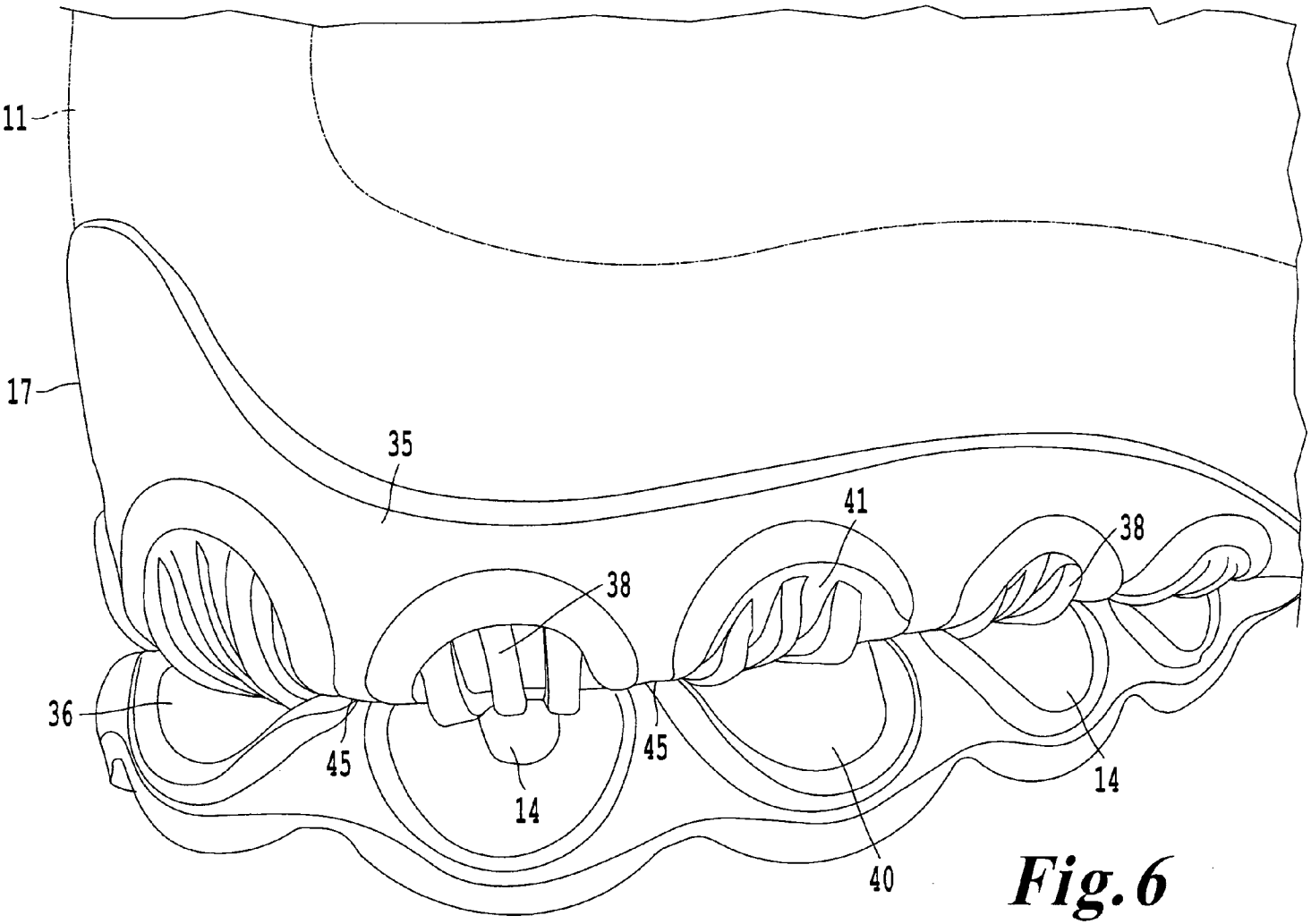
FIG. 6 is a side lateral view of the tube members according to a further example of the invention.
Figure 7:
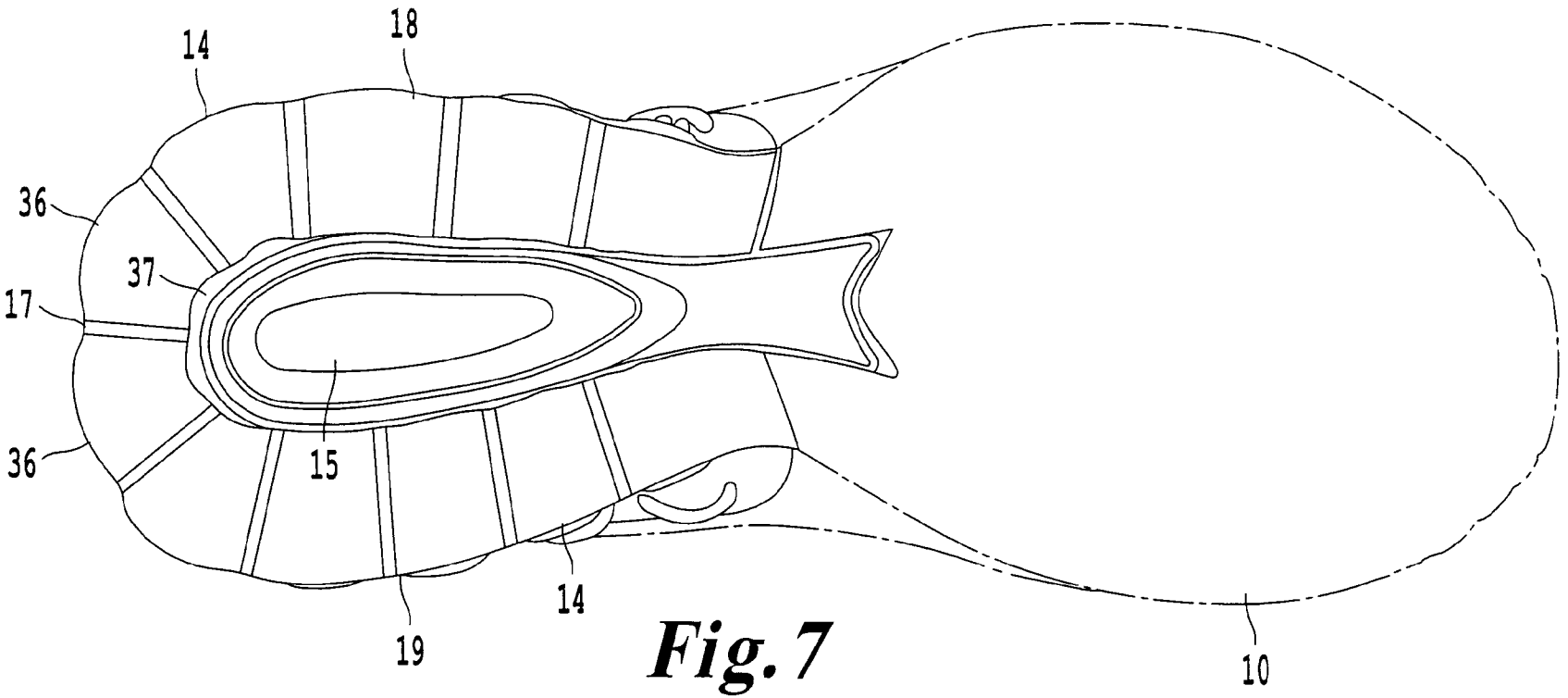
FIG. 7 is a bottom view of the tube members shown in FIG. 6.

In a further example of the invention shown in FIGS. 6 and 7, the shoe 10 can include a plurality of tubes 14 located from the lateral side 19 of the shoe to the medial side 18 and include tubes 36 that are located in the heel end 17 with one end facing in substantially a rearward direction out the back of the shoe 10. That is, tubes can be located from an area of the shoe 10 in at least a middle portion of the shoe, around the heel 17 of the shoe and to the other side of the shoe. For example, the exterior side of the tubes located in the heel region 17, face towards the back of the shoe. An interior end 37 of one or more tubes in the heel region 17 substantially faces a front direction of the shoe. The tubes 36 facing to the rear of the shoe can have a size that is the same or different from the tubes extending around a remainder of the outsole. In an example, a diameter of the tubes decreases in size going from a rear portion of the shoe towards a forefoot region of the shoe.

In an example, a support portion 35 is secured to or formed as a part of a bottom region of the shoe upper 11 and is engaged and secured to the portion of the outsole forming the remaining part of the tubes 14. In an example, the support portion 35 is made from different material than the other portion of the outsole forming the remaining portion of tubes 14. In one embodiment, the support portion 35 is made from carbon fiber or plastic and the tubes 14 are made from rubber. The support portion 35 can be secured to the tubes by known means suitable to allow the support portion 35 and tubes to provide a secure connection, cushioning and structural stability for the user.

In an example of the invention, the support portion 35 forms an upper region of the tube, and the lower region of the tube 14 is formed from different material and secured to the support portion 35. The area of the support portion 35 that forms an upper region 41 of one or more of the tubes 14 can have projections 38 formed therein facing in a direction of the inner bottom surface 40 of the tube. The projections 38 can be any shape or size and made from any desirable material. Further any number of projections 38 can be provided with the tube 14 and can extend any distance along the length of the tube 14. It should be appreciated that the one or more projections 38 can also be provided on the inner bottom surface 40 of the tube 14 and face upwards towards the inner upper surface 41 of support portion 35.

As shown in FIG. 6, the inner lower surface 40 of the tube 14 can be a curved surface facing the support portion 35 of the shoe 10. In this example, the curved surface 40 extends along the length of the tube from an exterior surface side of the tube to the second side facing the interior center region 15. The surface of the support portion 35 facing the curved surface 40 of the tube 14 can also be curved. Also, at least one region of the support portion 35 that faces the curved surface 40 of tube 14 can have a substantially planar region that is not curved. For example, in a region substantially below the user's foot, the support portion that forms the upper portion of the tube 14 can be formed to be substantially planar and face the inner curved surface 40 of the tube 14. Accordingly, one or more examples of the invention provides for a tube to be made from a substantially curved portion as well as a substantially planar portion. As such, it is within the spirit and scope of one or more embodiments of the invention to have curved and/or planar regions along the inner top surface of the tube and/or inner lower surface of the tube 14.

In one or more examples of the invention, a region adjacent the curved lower portion 40 of the tubes 14 contacts and is secured to a corresponding surface of the outsole, in this example, the support portion 35. For example, adjacent curved tube portions 14 are substantially planar regions 45 that form a gap between the curved portions. The gap between the tubes 14 can be the same or different for the multiple tubes 14 of the shoe 10. The planar regions 45 contact substantially planar regions of the support portion 35. In the example of FIGS. 6 and 7, the support portion 35 includes a substantially planar region that engages the substantially planar region 45 of the material forming the lower half of the tubes 14. The two substantially planar regions are secured together in a known manner, for example by an adhesive.

In a further example, the substantially planar region of the support portion 35 can have cavities or grooves formed to receive the planar regions 45 of the lower portion of the tube. The cavities or grooves can extend from the lateral or medial side of shoe a distance towards center region 15 at least substantially corresponding to the length of the tube portion 14 secured thereto. For example, each cavity can receive therein the planar region 45 formed between adjacent tubes 14 to secure the lower tube portion to the remainder of the shoe 10, to for example the support portion 35. That is, the area between tube members 14 can be a connecting portion from one tube member to another tube member and also can be a securing portion to connect the remainder of the shoe 10.

It should be appreciated that the cavities or grooves are optional and the tubes 14 can be secured directly to the shoe 10 using for example an adhesive, stitching, or molding together instead of being received in the cavities and then secured. FIG. 6 shows a view of outsole 13 with multiple tubes 14 connected to each other and provided with the planar region there between, which connects to the shoe. Therefore, in one or more embodiments of the invention, outsole 13 has a plurality of tubes 14 that are bonded to the shoe so as to provide a shoe with enhanced stability and support upon impact due to the tube members 14. In a further example of the invention, the curved portions of the tubes can be provided immediately adjacent each other with no planar regions to form a gap there between.

Figure 8:
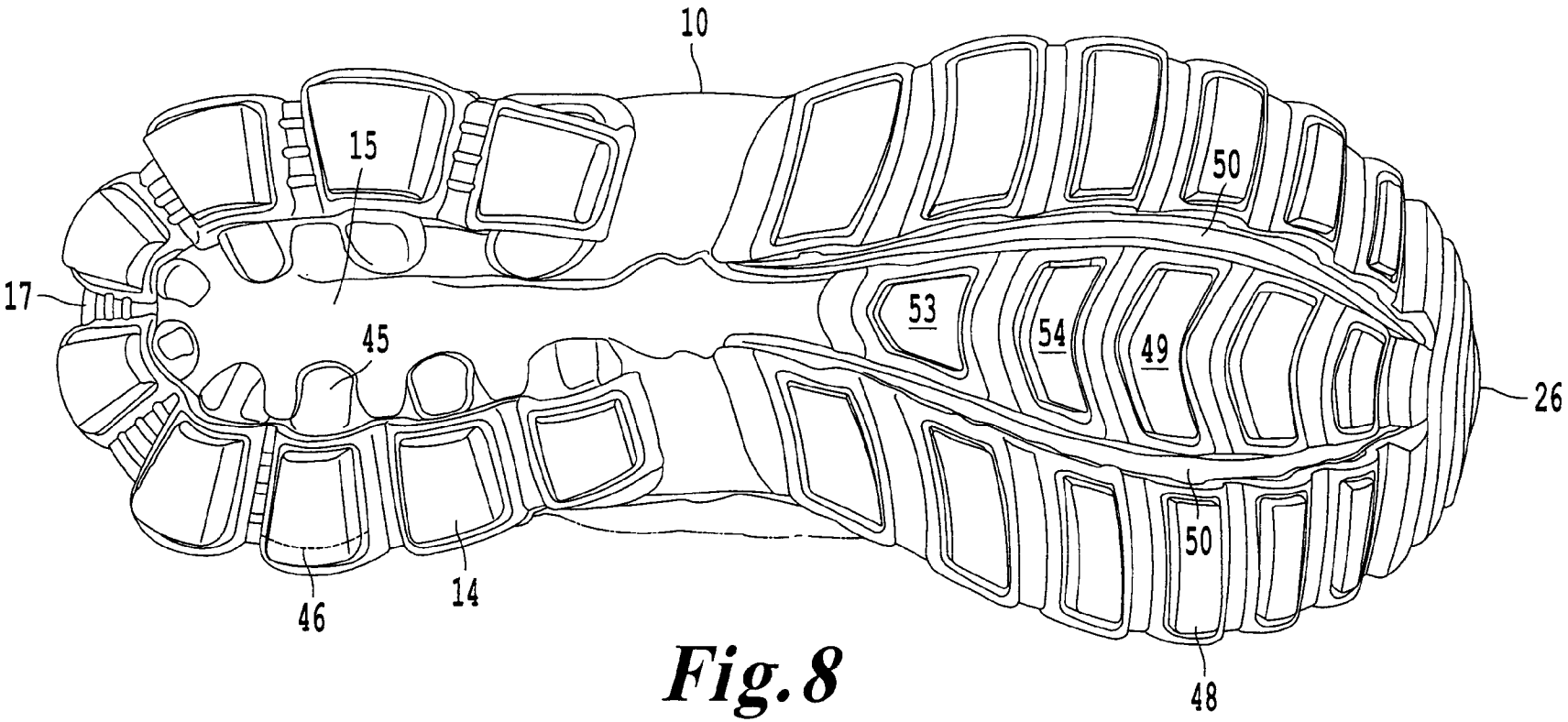
FIG. 8 is a bottom view of an embodiment of the invention.
Figure 9:
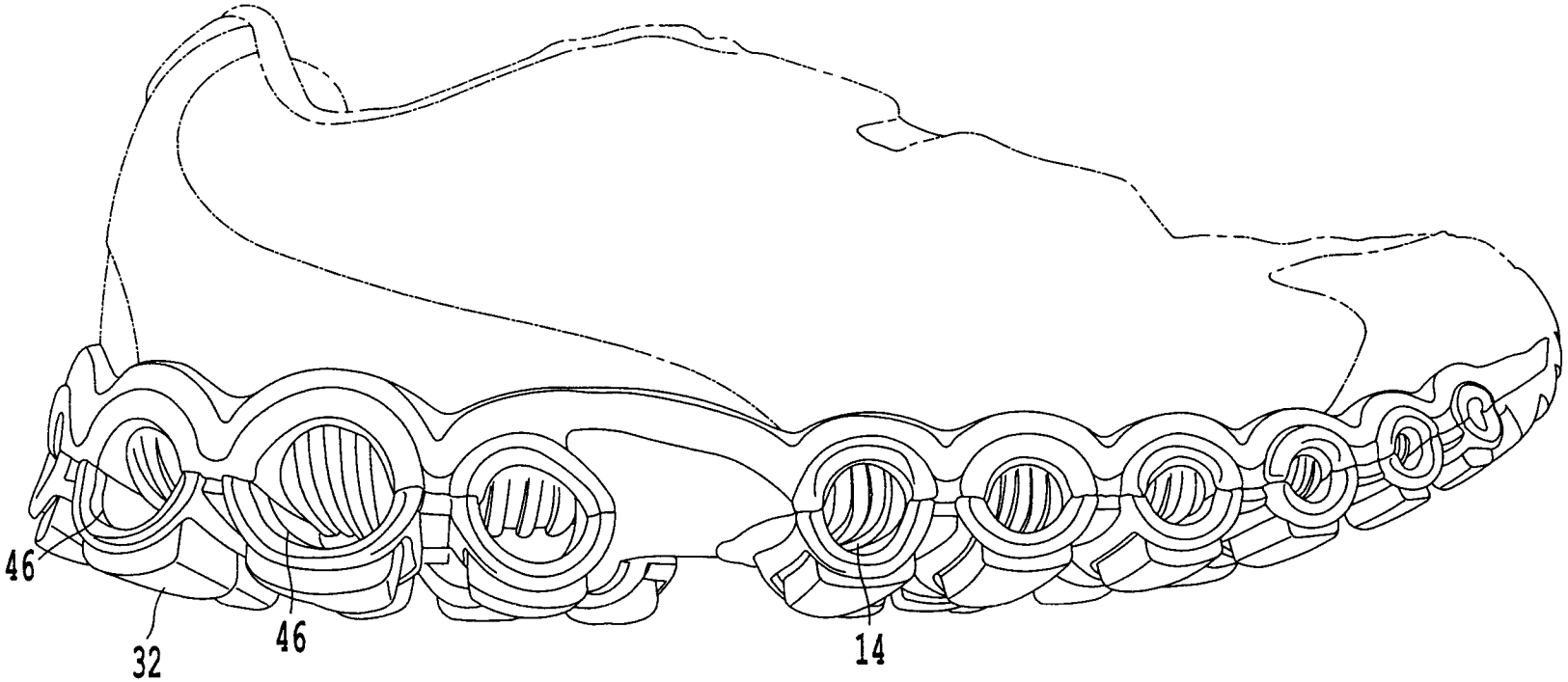
FIG. 9 is a lateral side view of the tube members shown in FIG. 8.
Figure 10:
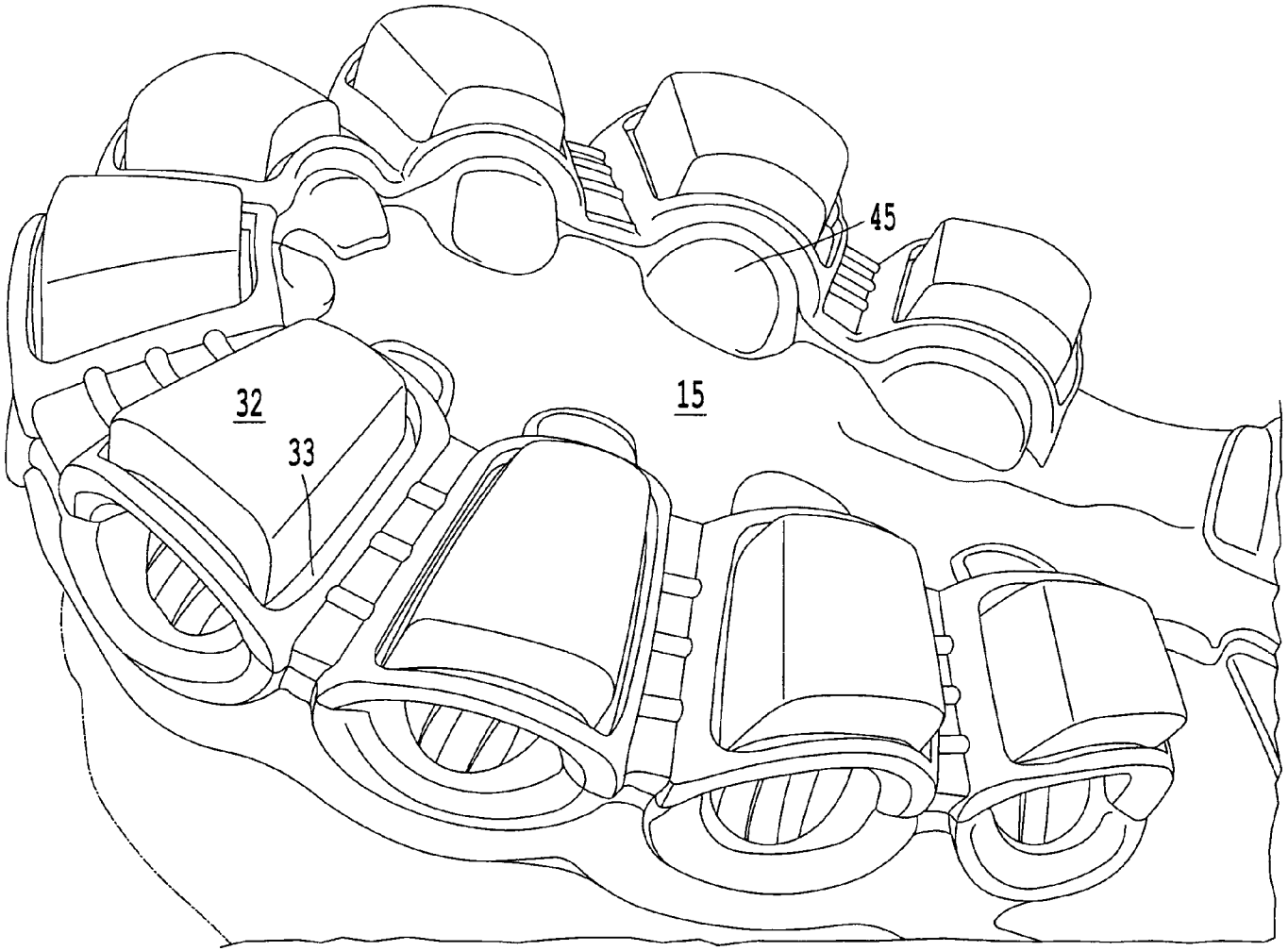
FIG. 10 is a bottom view of an embodiment of the invention shown in FIG. 8.

In a further example of the invention shown in FIGS. 8-10, one or more of the tubes 14 can be closed at least at one end of the tube 14. In an example, the end of one or more tubes 14 facing towards the center portion 15 is closed. It should be appreciated that an embodiment includes only some of the tubes 14 having a closed end. In an example, tubes 14 located in the heel area 17 can each have at least one closed end while one or more tubes 14 located in a middle portion and/or in the forefoot region do not have a closed end.

In an example, the center portion 15 of the outsole 13 can be made at least partially from different material from the remaining portions of the outsole 13. The center portion 15 can be made from material that is firmer or more dense, for example plastic or carbon fiber, than the remainder of the outsole 13 and/or the tubes 14. In this example, the tubes 14 are made from rubber while center portion 15 is plastic. The center portion 15 can include raised portions 45 provided to cover the end of the tube 14 facing the center portion 15. The raised portions 45 can extend up to the opening of the tube 14 and then extend within an interior of the tube 14 for any desirable length. The raised portion 45 can be associated with one or more of the tubes 14.

In an example, the raised portions 45 extend up from the center portion 15 and along at least part of a length of an inside of the one or more tubes 14 along a top and/or bottom surface of the tube interior. That is, the raised portion 45 can extend around all or part of the interior of one or more tubes. The raised portion 45 can extend along any distance on the inside of the tube 14. Further the raised portion 45 can extend different distances on the inside of tube 14 depending on the location of the tube 14 on the bottom of the outsole 13. For example, the raised portion 45 can extend a distance indicated at 46 shown in FIG. 8, however, a different raised portion 45 can extend only midway along the length of another tube 14. The raised portion 45 can be made of a material that is more rigid than other tube material. The raised portion 45 provided in one or more of the tubes 14 can be made of a material that can partially compress upon use by the wearer.

The raised portion 45 can be curved or planar to match the inner curved or planar regions of the lower and/or upper portion of the tube 14. The raised portion 45 can also be provided with a different shape than the tube 14. For example, a substantially planar portion can be provided along at least part of the raised portion 45 extending within the tube. The planar portion would provide a gap between the planar portion of the raised portion 45 and the curved portion of the tube 14, which will allow further compression and deformation of the tube 14.

In an example of the invention, the raised portion 45 extends in a curved manner in a direction of the ground along the inside of the lower curved surface of one or more tubes 14. The raised portion 45 in this example extends along substantially the length of the one or more tubes along approximately the lower half of the tube and is made from plastic, carbon fiber, or the like. The upper half of the tubes are provided by a portion of the outsole 13 and are made of a material softer than the raised portion 45, for example foam or rubber. In an example, the inside of the lower curved surface of the tube includes a grooved region that allows the raised portion 45 to reside therein. During use, due to the stiffer material used for the curved raised portion 45, the end of each side of the curve can push into the softer material of the outsole to provide cushioning that will dissipate the force of the foot impact and minimize the force transferred to the user.

As shown in FIG. 8, shoe 10 includes an outsole 13 having multiple tubes 14 formed in different areas of the outsole 13 and having different sizes, shapes, orientations, and/or curves, and formed adjacent to each other and extending from the rear 17 of athletic shoe 10 to the front 26 of the athletic shoe. In this embodiment, one or more tubes 14 positioned in the forefoot region of the shoe are provided substantially transverse to the longitudinal direction of the shoe 10 and extend from the outer lateral portion of outsole 13 to the inner medial portion of outsole 13 with a gap 50 there between. In this example there are three rows of tubes 14, however, any number of rows of tubes 14 can be provided. However, one or more of the tubes 14 located in the forefoot region can extend along the entire width of the outsole 13.

In this example, one or more tubes 48 located on the medial side and/or lateral side of the shoe 10 can be curved in a first direction while one or more tubes 49 located substantially along the longitudinal axis of the shoe 10 can be curved in a second direction, different from the first direction. Further, the tubes 14 located near a middle portion of the shoe 10 in one or more of the rows can have a larger size than the tubes 14 located near the toe end 26 of the shoe. As shown in FIG. 8, one or more tubes, for example tube 53 can be larger than an adjacent tube 54 provided in the same row. That is, a first end of the curved lower surface of tube 53 is spaced from the second end of the curved lower surface of tube 53 by a distance that is greater than the distance between the first and second ends of the curved lower surface of tube 54.

In this example, the top inner surface of tubes 14 can be curved to substantially mirror the curved lower surface, or the top inner surface can be substantially planar. It should be appreciated that in one or more examples of the invention, the curved top and/or bottom inner surfaces and/or the substantially planar top and/or bottom surfaces can be curved or planar along the longitudinal and/or lateral direction of the shoe 10.

Some of the factors in the amount of shock absorption each individual tube member provides can be determined by the softness of the material and/or the wall thickness of each tube for example. In an example of the invention, one or more of the tubes can have a variable wall thickness in the lengthwise direction and/or the widthwise direction of the tube. In one embodiment, the tube has a larger wall thickness at the ends or sides closer to the lateral side 19 and/or medial side 18 which will reduce in thickness towards the center region 15 of the shoe 10. That is, one or more tubes can have a thicker wall thickness formed along the edges, which tapers to a thinner wall thickness towards a middle which can provide more deflection and/or compression upon contact with a firm surface in the regions of the tube having the thinner wall thickness. As a further example of the invention, one or more tubes can have one or both of the end portions thicker than a middle portion along the length of the tube. Alternatively, one or more tubes provided on the lateral 19 and/or medial 18 side can have thinner regions along the edge of the tube and a thicker wall thickness in a direction of the center region 15. The mechanical compressing and flexing of the one or more tubes can provide increased shock absorption and support. The tubes can provide stability as the tubes transition from a thin wall to a thicker wall.

Figure 11:
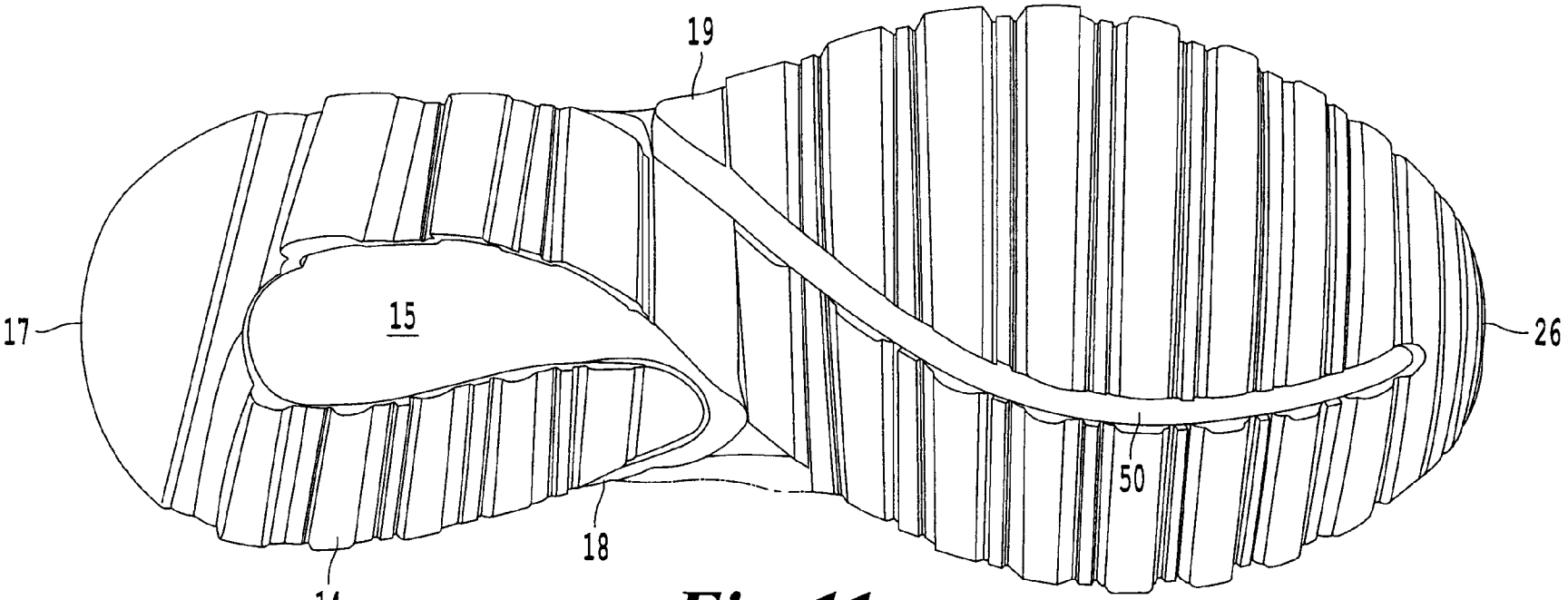
FIG. 11 is a bottom view of a further example of the invention.
Figure 12:
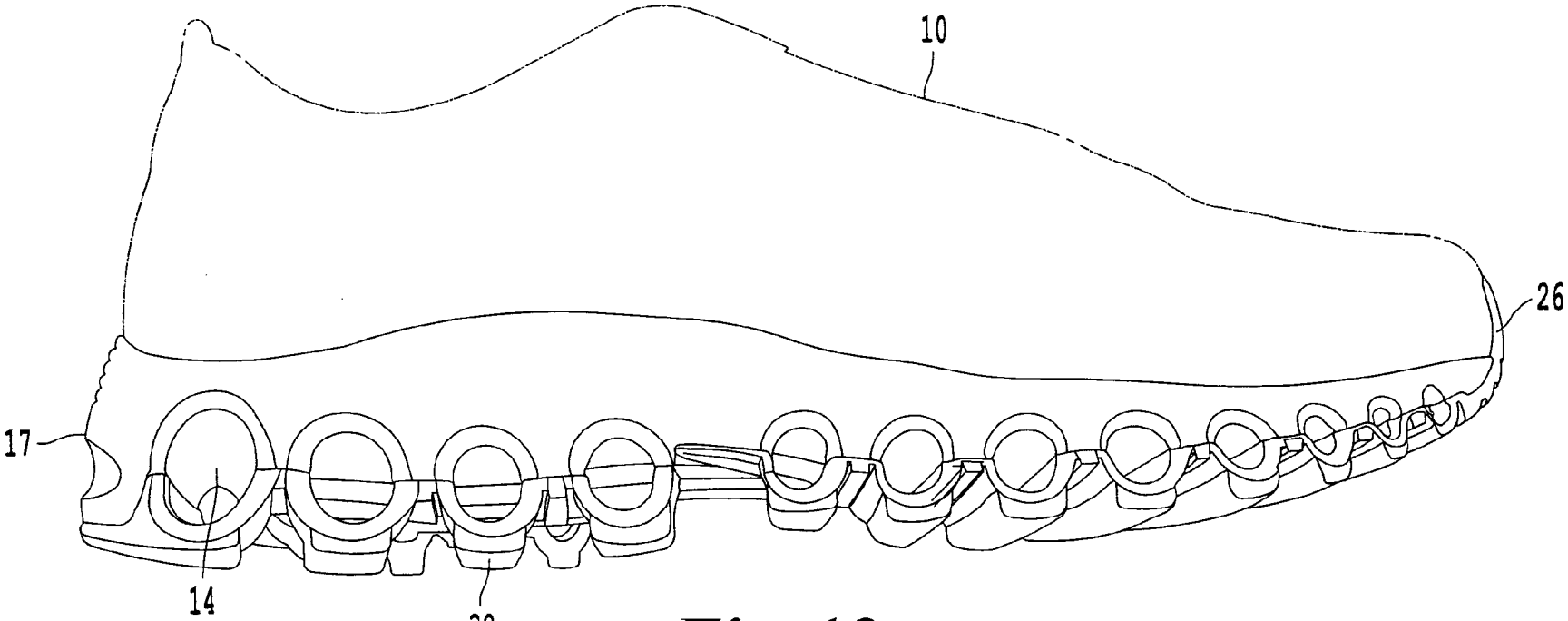
FIG. 12 is a lateral side view of the example of the invention shown in FIG. 11.

In a further example of the invention shown in FIGS. 11 and 12, the shoe 10 includes a plurality of tubes 14 that extend varying lengths across the width of the shoe. For example, in the forefoot region of the shoe 10, the gap 50 curves from substantially a middle portion of the shoe to substantially the toe end 26 thereby spacing apart the tubes 14 extending from the lateral side 19 from the tubes extending from the medial side 18. In this example, because the gap 50 is provided in a curved manner, one or more of the tubes 14 on the lateral side 19 adjacent each other can have a different length from each other. Due to the gap 50 curving in a substantially similar manner to the outer curve of the shoe, one or more of the tubes 14 on the medial side 18 can have the same or similar length. It should be appreciated that one or more of the tubes from either side can be the same or different lengths.

As shown in FIG. 11, the gap 50 is provided by a substantially constant curve. However, it should be appreciated that the gap 50 can be any shape, for example a wavy line, zig-zag pattern, and the like. Further, if more than one gap 50 is provided as shown in FIG. 8, the more than one gap 50 can have the same or different pattern. Along with providing different orientations, shapes, sizes, thicknesses, etc. as discussed with respect to one or more embodiments of the invention, the one or more gaps 50 providing spacing in between one or more rows of tubes 14 can help alter the performance characteristic of the shoe 10.

Thus, it is apparent that there has been provided in accordance with the invention, a cushioning structure for an article of footwear that fully satisfies the objects, aims and advantages discussed herein. While the invention has been described in conjunction with specific embodiments thereof, obviously, numerous modifications and variations of the present invention would be apparent to those skilled in the art in light of the above teachings. It is therefore to be understood that within the scope of the appended claims, the invention may be practiced otherwise than as specifically described herein.

The invention claimed is:

1. A shoe having a longitudinal axis, comprising:

an upper;

an outsole secured to the upper; and a plurality of cushioning elements attached to a bottom surface of the outsole, wherein the plurality of cushioning elements extend partially across a width of the outsole so that cushioning elements provided on a lateral side of the shoe are spaced apart in a direction transverse to the longitudinal axis from cushioning elements provided on a medial side of the shoe, wherein a longitudinal axis of a first one of the cushioning elements is oriented at a first angle with respect to the longitudinal axis of the shoe, and a longitudinal axis of a second one of the cushioning elements formed adjacent the first one of the cushioning elements is oriented at a second angle with respect to the longitudinal axis of the shoe different than the first angle, wherein the outsole and each of the plurality of cushioning elements form a plurality of tubes designed to compress to absorb loads associated with foot impact, each of the plurality of tubes including a substantially circular inner tubular surface formed by a downwardly curved inner surface of the outsole joined to an upwardly curved inner surface of the cushioning element, wherein each of the plurality of cushioning elements includes a ground-facing surface including a first portion that is concentric with the upwardly curved inner surface of the cushioning element, and a second portion that radially extends from the first portion such that an outer surface of the second portion extends radially beyond an outer surface of the first portion, and wherein the second portion is arranged to contact a ground surface, and wherein the first portion of the ground facing surface includes a recess therein, and wherein the second portion protrudes from the recess.

2. The shoe according to claim 1, wherein the plurality of cushioning elements are provided around at least a portion of a perimeter of the shoe.

3. The shoe according to claim 2, wherein the plurality of cushioning elements are provided around a perimeter of a heel portion of the shoe from a lateral side of the shoe around the heel portion to the medial side of the shoe.

4. The shoe according to claim 3, wherein the cushioning elements are not provided in a central region of the heel portion such that the cushioning elements are spaced from each other by the central region.

5. The shoe according to claim 1, wherein a longitudinal axis of three or more of the cushioning elements are oriented at an angle different from each other with respect to a longitudinal axis of the shoe.

6. The shoe according to claim 1, wherein the upwardly curved inner surface and the downwardly curved inner surface extend an entire length of the cushioning element.

7. The shoe according to claim 1, wherein a length of an upper surface of the outsole element includes said downwardly curved inner surface and a portion that is substantially planar.

8. The shoe according to claim 1, wherein an area of an interior of one or more of the plurality of cushioning elements decreases in a direction from an end of the cushioning element facing in a direction away from the shoe to an end of the cushioning element facing a middle portion of the shoe.

9. The shoe according to claim 1, wherein a support structure is provided within an interior of one or more of the plurality of tubes.

10. The shoe according to claim 9, wherein the support structure is made from a different material than the upwardly curved inner surface of the one or more tubes.

11. The shoe according to claim 10, wherein the support structure is made of one of plastic or carbon fiber, and the upwardly curved inner surfaces are made of one of rubber or thermoplastic polyurethane.

12. The shoe according to claim 9, wherein the support structure extends along at least substantially an entire length of an upper surface of the one or more tubes.

13. The shoe according to claim 12, wherein at an end of the one or more tubes facing towards a middle portion of the shoe, the support structure covers an opening of the end.

14. The shoe according to claim 1, wherein the outsole includes a plurality of substantially planar regions extending in a direction of the longitudinal axis of the shoe and provided between one or more adjacent cushioning elements, the planar regions forming a gap extending in the direction of the longitudinal axis of the shoe and between adjacent cushioning elements.

15. The shoe according to claim 1, wherein a thickness of one or more of the tubes varies along the longitudinal axis of the one or more tubes.

16. The shoe according to claim 1, wherein a wall thickness of one or more of the tubes is greater in an area adjacent the medial side of the shoe than in an area adjacent the lateral side of the shoe.

17. The shoe according to claim 16, wherein the wall thickness of one or more of the tubes is greater adjacent one or both edges of the downwardly curved inner surface, than at a middle region of the downwardly curved inner surface.

18. The shoe according to claim 1, further including at least one cushioning element which extends from a lateral side of the shoe to a medial side of the shoe.

19. The shoe according to claim 18, wherein the at least one cushioning element that extends from the lateral to the medial side of the shoe is located at a heel end of the shoe.

20. The shoe according to claim 1, wherein the medial side of the shoe includes more cushioning elements than the lateral side of the shoe.

21. The shoe according to claim 20, wherein a cross-sectional area provided by a space within the tubes is smaller on average for the tubes on the medial side than tubes on the lateral side.

22. The shoe according to claim 1, wherein the cushioning elements are locked in a region extending from a heel region of the shoe to a forefoot region of the shoe.

23. The shoe according to claim 22, wherein with respect to the longitudinal axis of the shoe the cushioning elements provided in a middle region of the shoe are larger than cushioning elements located closer to a toe region of the shoe.

24. The shoe according to claim 1, wherein cushioning elements provided in a heel area of the shoe are provided further away from a longitudinal axis of the shoe than cushioning elements provided closer to a toe end of the shoe.

25. The shoe according to claim 1, wherein the plurality of cushioning elements deforms in one or more of a substantially horizontal, substantially vertical and substantially lateral direction.

26. The shoe according to claim 25, wherein a substantially planar region is provided between adjacent cushioning elements so that adjacent cushioning elements are spaced apart from each other in a direction of the longitudinal axis of the shoe.

27. The shoe according to claim 1, wherein the upwardly curved inner surface is made from a different material than the downwardly curved inner surface.

28. The shoe according to claim 1, wherein the first portion of the ground-facing surface of each of the plurality of cushioning elements is an arched surface extending approximately 180 degrees.

29. The shoe according to claim 1, wherein in a heel region of the shoe the tubes are provided at a perimeter of the shoe but not at a central portion of the heel region.

30. The shoe according to claim 1, wherein:

(a) in a heel region of the shoe, the tubes are provided at a perimeter of the shoe but not at a central portion of the heel region; and (b) in a forefoot region of the shoe, tubes are provided at the perimeter of the shoe, and in a central portion of the forefoot region a plurality of tubes are provided which are separate from and spaced from the tubes provided at the perimeter of the forefoot region.

31. A shoe having a longitudinal axis, comprising:

an upper;

an outsole secured to the upper; and a plurality of cushioning elements attached to a bottom surface of the outsole, wherein the plurality of cushioning elements extend partially across a width of the outsole so that cushioning elements provided on a lateral side of the shoe are spaced apart in a direction transverse to the longitudinal axis from cushioning elements provided on a medial side of the shoe, wherein a longitudinal axis of a first one of the cushioning elements is oriented at a first angle with respect to the longitudinal axis of the shoe, and a longitudinal axis of a second one of the cushioning elements formed adjacent the first one of the cushioning elements is oriented at a second angle with respect to the longitudinal axis of the shoe different than the first angle, wherein the outsole and each of the plurality of cushioning elements form a plurality of tubes designed to compress to absorb loads associated with foot impact, each of the plurality of tubes including a substantially circular inner tubular surface formed by a downwardly curved inner surface of the outsole joined to an upwardly curved inner surface of the cushioning element, wherein each of the plurality of cushioning elements includes a ground-facing surface including a first portion that is concentric with the upwardly curved inner surface of the cushioning element, and a second portion that radially extends from the first portion such that an outer surface of the second portion extends radially beyond an outer surface of the first portion, and wherein the second portion is arranged to contact a ground surface, and wherein at least one of the plurality of tubes includes:

(a) an opening defined by the downwardly curved inner surface and the upwardly curved inner surface which is larger at a periphery of the shoe than at a location closer to a middle region of the shoe; and (b) a plurality of projections projecting downwardly from the downwardly curved inner surface inside of the at least one of the plurality of tubes.

32. The shoe according to claim 31, wherein the first portion of the ground facing surface includes a recess therein, and wherein the second portion protrudes from the recess.

33. The shoe according to claim 31, wherein each of the plurality of projections extends in a lengthwise direction of the at least one tube.

* * * * *